United States Patent [19]

Matsubara et al.

[11] 3,967,551

[45] July 6, 1976

[54] PRINT MECHANISM WITH ROCKABLE INTERPOSING LEVER FOR PRINT HAMMER

[75] Inventors: Toru Matsubara, Chofu; Toshikazu Nakano, Fuchu, both of Japan

[73] Assignee: Tokyo Juki Kogyo Kabushiki Kaisha, Chofu, Japan

[22] Filed: July 21, 1975

[21] Appl. No.: 597,817

[30] Foreign Application Priority Data

July 31, 1974 Japan ..... 49-88236

[52] U.S. Cl. ..... 101/93.31; 197/49; 335/238; 101/93.48

[51] Int. Cl.[2] ..... B41J 9/10; B41J 9/26

[58] Field of Search ..... 101/93.02, 93.21, 93.29, 101/93.3, 93.31, 93.32, 93.48; 335/238, 275, 276; 197/49

[56] References Cited

UNITED STATES PATENTS

| | | | |
|---|---|---|---|
| 3,673,956 | 7/1972 | Huber et al. | 101/93.31 |
| 3,795,185 | 3/1974 | Shimodaira et al. | 101/93.31 |
| 3,804,009 | 4/1974 | Blume | 101/93.48 |
| 3,850,098 | 11/1974 | Morohashi | 101/93.31 |
| 3,881,412 | 5/1975 | Thevis | 101/93.48 |

OTHER PUBLICATIONS

IBM Tech. Disc. Bulletin, J. W. Kerr, vol. 9, No. 2, July 1966, pp. 130–132.

*Primary Examiner*—Edgar S. Burr
*Assistant Examiner*—Paul T. Sewell
*Attorney, Agent, or Firm*—Wenderoth, Lind & Ponack

[57] ABSTRACT

A typewriting device comprising a type-carrying drum continuously driven from a drive source, a ratchet wheel continuously driven from said drive source in synchronization with said drum and having a pawl thereon, at least one rocking lever pivoted to a shaft, at least one armature pivoted to said shaft, at least one electromagnet disposed adjacent to said armature adapted to be energized to attract said armature thereto, at least one operation lever supported on a second shaft for rotation about and movement vertically along said second shaft, and at least one hammer lever pivoted to a third shaft for striking said drum to effect a typewriting operation.

4 Claims, 3 Drawing Figures

PRINT MECHANISM WITH ROCKABLE INTERPOSING LEVER FOR PRINT HAMMER

BACKGROUND OF THE INVENTION

This invention relates to a typewriting device and more particularly, to a typewriting device of the type in which the typewriting operation can be effected at a high speed while eliminating the so-called double typewriting during a single typewriting operation.

there have been proposed a great variety of typewriting devices and in one of the prior art typewriting devices, operation members which are adapted to deliver a striking force to hammer members, respectively, to cause the hammer members to effect a typewriting operation, respectively, are rotatably supported on a common shaft and armatures are provided in opposition to and spaced from normally deenergized magnets whereby when the typewriting device is operated for typewriting a selected type, the magnet associated with the selected type is energized to attract the armature associated with the energized magnet to thereby move the operation member associated with the attracted armature into the locus of rotation of the pawl on the ratchet wheel associated with the operation member whereupon the operation member strikes against the ratchet wheel which in turn causes the hammer member to effect the typewriting. Therefore, in the prior art typewriting device referred to above, in order for the energized magnet to attract its associated armature which is disposed apart from the magnet to the latter, the magnet is required to have a high magnetic force. Therefore, the overwall size of the typewriting device should be inevitably large resulting in an increase of production cost of the device. Furthermore, the prior art typewriting device has the disadvantage that the device can not be operated at a high speed. And since the operation member is positioned within the locus of rotation of the pawl on the ratchet wheel while the magnet is maintained energized, the operation member is struck by the pawl on the ratchet wheel two or more times during one typewriting operation resulting in the so-called double typewriting. Thus, the prior art typewriting device can not provide a clearcut written letter or character.

SUMMARY OF THE INVENTION

Thus, one principal object of the present invention is to provide a typewriting device which can eliminate the disadvantages inherent in the prior art typewriting devices referred to hereinabove.

Another object of the present invention is to provide a typewriting device which can effectively eliminate the so-called double typewriting during a single typewriting operation.

Another object of the present invention is to provide a typewriting device in which a spring-loaded rocking member assists the associated electromagnet in attracting the associated armature to the electromagnet so that the electromagnet is not required to have a high magnetic force resulting in reduction of the overall size of the device and production cost of the device.

The above and other objects and attendant advantages of the present invention will be more readily apparent to those skilled in the art from a reading of the following detailed description in connection with the accompanying drawings which show one preferred embodiment of typewriting device of the invention for illustration purpose only, but not for limiting the scope of the invention in any way.

BRIEF DESCRIPTION OF THE DRAWINGS

The accompanying drawings show the typewriting device of the invention in side elevation in which.

PREFERRED EMBODIMENT OF THE INVENTION

Figure 1:
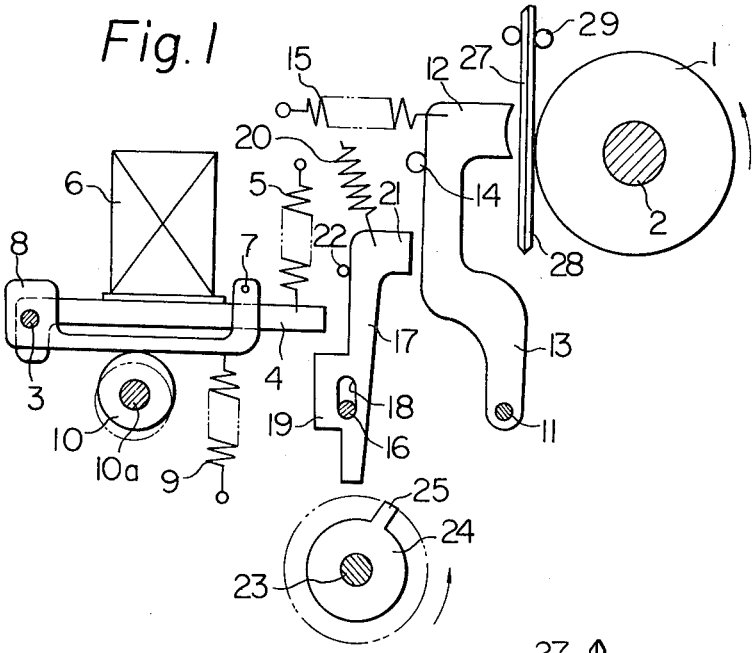
FIG. 1 is a fragmentary side elevational view of said typewriting device showing the positions of various parts of the device in a rotated position of one cam member after one typewriting operation.

The present invention will now be described referring to the accompanying drawings which illustrate one preferred embodiment of the typewriting device of the invention. The typewriting device generally comprises a type-carrying drum 1 having a plurality of rows of types in the outer periphery and fixedly mounted on a transverse drive shaft 2 which is connected to a suitable drive source (not shown) to be continuously driven thereby and journalled at the opposite ends in the machine frame (not shown). A transverse shaft 3 is journalled at the opposite ends in the machine frame (not shown) and extends in parallel to the drum drive shaft 2. An armature 4 is pivoted at one end to the shaft 3 and the other end of the armature has one end of a coiled spring 5 anchored thereto while the other end of said spring is anchored to the machine frame (not shown) for normally urging the armature upwardly. An electromagnet 6 is suitably supported in the machine frame (not shown) adjacent to the upper surface of the armature 4 so as to attract the armature thereto when the electromagnet is energized. A rocking lever 8 is pivoted at one end to the shaft 3 to which the armature 4 is also pivoted and has a pin 7 projecting laterally from the other end of the lever for engagement with the upper surface of the armature 4. A coiled spring 9 is anchored at one end to the other end of the lever 8 extending in the direction opposite from the direction in which the coiled spring 5 extends and the other end of the coiled spring 9 is suitably anchored to the machine frame (not shown) so as to normally urge the lever 8 in the clockwise direction as seen in the drawings. An eccentric cam 10 is mounted on a shaft 10*a* positioned adjacent to the under surface of the lever 8 and adapted to be intermittently driven by the above-mentioned drive source common to the drive shaft 2. The cam member 10 is in contact with the under surface of the lever 8. For the purpose, the force of the coiled spring 9 is selected as being greater than that of the coiled spring 5, but smaller than the combination of the magnetic force of the electromagnet 6 and the force of the coiled spring 5. A transverse shaft 11 extends between and parallel to the drive shaft 2 and shaft 10*a* and is suitably journalled at the opposite ends in the machine frame (not shown). A hammer lever 13 is pivoted at the lower end to the shaft 11 and has a laterally extending striking portion 12 at the other or upper end in opposition to the type-carrying drum 1. A coiled spring 15 is anchored at one end to the upper end of the hammer lever 13 and the other end of the spring is suitably anchored to the machine frame (not shown) so as to normally urge the hammer lever 13 in the counter-clockwise direction away from the type-carrying drum 1 until the left-hand side of the hammer lever 13 engages a stop pin 14 extending laterally from the machine frame (not shown) adjacent to the hammer lever 13. A transverse shaft 16 is provided between and parallel to the shafts 10*a* and 11 and a rockable operation lever 17 is loosely mounted on the shaft 16 and has a laterally extending striking portion 21 at the upper end in opposition to the hammer lever 13. The lower end portion of the operation lever 17 is formed with a laterally extending bulge 19 on the side opposite from the side of the operation lever where the striking portion 21 is formed and a vertical elongated slot 18 is provided in the bulge 19. Thus, the operation lever 17 may rock about the shaft 16 and also move vertically along the shaft 16 within the limit defined by the length of the slot 18. A coiled spring 20 is anchored at one end to the operation lever 17 and the other end of the spring is suitably anchored to the machine frame (not shown) so as to normally urge the operation lever 17 in the counter-clockwise direction away from the hammer lever 13. The rocking movement of the operation lever 17 in the counter-clockwise direction is limited by a stop pin 22 provided adjacent to the left-hand side of the operation lever 17 and extends laterally from the machine frame (not shown). A transverse shaft 23 is provided below the operation lever 17 in parallel to the shaft 16 and is suitably journalled at the opposite ends in the machine frame (not shown). The shaft 23 is continuously driven from the above-mentioned drive source (not shown) common to the type-carrying drum 1. A ratchet wheel 24 having a pawl 25 in the outer periphery is fixedly secured to the shaft 23. An intermittently driven feed mechanism 29 is provided between the type-carrying drum 1 and hammer lever 13 so as to intermittently feed a typewriting paper 27 and an inked ribbon 28 side by side relationship in the path defined between the drum 1 and hammer lever 13.

Figure 2:
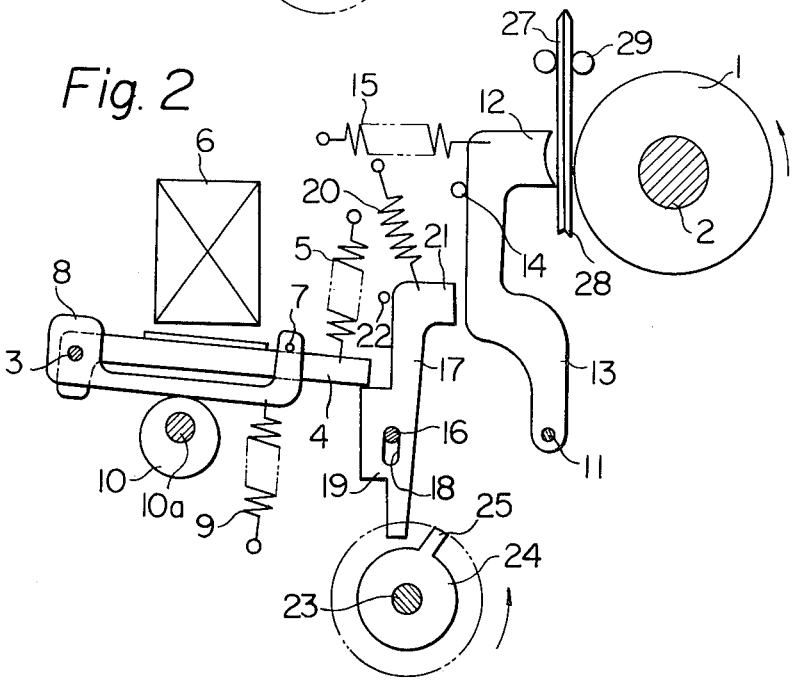
FIG. 2 is a fragmentary side elevational view of said device when one electromagnet is in its deenergized state.

The mutual relationship between the electromagnet 6, armature 4, rocking lever 8, operation lever 17, hammer lever 13, cam member 10 and ratchet wheel 24 is such that when the electromagnet 6 is in its energized state, the electromagnet 6 attracts the armature 4 toward itself to position the free or left-hand end of the armature 4 above the bulge 19 on the operation lever 17 as shown in FIG. 1. In this position of the armature 4, the lower end of the operation lever 17 is positioned out of the locus of rotation of the pawl 25 on the ratchet wheel 24. When the electromagnet 6 is deenergized, the rocking lever 8 is urged to rotate in the clockwise direction about the shaft 3 under the force of the coiled spring 9 which in turn pivots the armature 4 in the clockwise direction as shown in FIG. 2 so as to engage the bulge 19 to push the operation lever 17 whereupon the lower end of the operation lever 17 is positioned within the locus of rotation of the pawl 25 on the ratchet wheel 24. The lower end of the operation lever 17 strikes against the pawl 25 on the rotating ratchet wheel 24 to be rotated about the shaft 16 in the clockwise direction to strike against the hammer lever 13 which in turn pivots about the shaft 11 to strike against the drum 1 through the typewriting paper 27 and ribbon 28 to thereby effect one typewriting operation. After the typewriting operation has been completed, the operation lever 17 is caused to rock about the shaft 16 in the counter-clockwise direction under the force of the coiled spring 20 to disengage from the armature 4 so as to displace the lower end of the lever 17 out of the locus of rotation of the pawl 25 of the ratchet wheel 24 (see FIG. 3). Thereafter, when the rocking lever 8 is pushed up by the rotating cam member 10, the now energized magnet 6 attracts the armature 4 toward itself (see FIG. 1) and the pin 7 on the rocking lever 8 is positioned above the armature 4.

Although not shown, it should be understood that a plurality of armatures 4 and the same number of rocking levers 8 are pivoted to the common shaft 3 and one electromagnet 6 is provided for cooperating with each of the armatures 4, that a plurality of operation levers 17 are freely supported on the common shaft 16 for cooperating with the rocking levers 7, respectively and that a plurality of hammer levers 13 are pivoted to the common shaft 11 for cooperating with the operation levers 17, respectively. It is also noted that a plurality of ratchet wheels 24 having the pawls 25 are provided for engaging the operation levers 17, respectively.

With the above-mentioned construction and arrangement of the parts of the typewriting device of the present invention, while the typewriting device is in its position waiting for one particular typewriting operation, the type-carrying drum 1 and ratchet wheels 24 are continously rotated in the arrow direction and the electromagnets 6 are maintained energized. Therefore, the armatures 4 are attracted to the electromagnets 6 with the right-hand ends of the armatures positioned above or separated from the bulges 19 on the operation levers 17 and as a result the lower ends of the operation levers 17 are positioned out of the loci of rotation of the pawls 25 on the ratchet wheels 24. And the striking portions 12 on the hammer levers 13 are urged in the counter-clockwise direction about their shafts 11 under the force of the associated coiled springs 15 and maintained in the neutral position in which the hammer levers 13 are separated from both the type-carrying drum 1 and the striking portions 21 on the operation levers 17, and the cams 10 separate from the rocking levers 8 (shown by the dot-chain line in FIG. 1).

When it is desired to typewrite a selected type of the types on the drum 1 onto the paper 27, just before the type ahead of the selected type passes by the position where the preceding type faces the striking portion 12 of the hammer lever 13 associated with the selected type, the key (not shown) associated with the selected type is depressed down to deenergize the associated electromagnet 6 whereupon the rocking lever 8 associated with the deenergized electromagnet 6 is caused to rock about the shaft 3 in the clockwise direction under the force of the associated spring 9. The rocking lever 8 in turn pivots the associated armature 4 about the shaft 3 in the clockwise direction by means of its pin 7 against the force of the associated coiled spring 5 and as the armature 4 rotates in the clockwise direction, the armature engages and pushes the bulge 19 on the associated operation lever 17 downwardly whereby the operation lever 17 is guided downwardly by means of its slot 18 and the shaft 16 against the force of the associated coiled spring 20 until the lower end of the operation lever 17 is positioned within the locus of rotation of the pawl 25 on the associated ratchet wheel 24 (FIG. 2). As the operation lever further continues to move downwardly, the lower end of the operation lever 17 strikes against the pawl 25 on the rotating ratchet wheel 24 whereupon the lever 17 is rotated in the clockwise direction about the shaft 16 by the pawl 25 against the force of the coiled spring 20. As the operation lever 17 continues to rotate in the clockwise direction, the striking portion 21 on the operation lever 17 strikes against the hammer lever 13 with a sudden blow at a point between the upper and lower ends of the latter which in turn rotates in the clockwise direction about the shaft 11 against the force of the coiled spring 15 to thereby cause the striking portion 12 on the hammer lever 13 to strike against the selected type of the types carried on the drum 1 with the paper 27 and ribbon 28 interposed therebetween so as to effect the typewriting of the selected type onto the paper 27.

Figure 3:
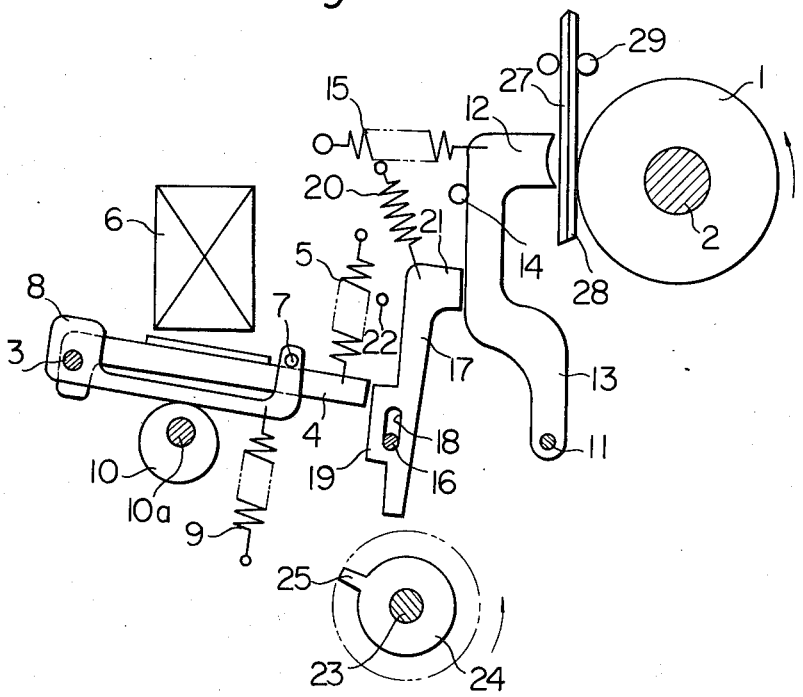
FIG. 3 is a fragmentary side elevational view of said device showing the positions of various parts of the typewriting device just after one typewriting operation has been completed.

As the operation lever 17 continues to rotate in the clockwise direction after the typewriting operation has been completed, the bulge 19 on the operation lever 17 is disengaged from the armature 4 whereupon the operation lever is pulled upwardly under the force of the coiled spring 20 until the bottom of the slot 18 engages the shaft 16 and as a result, the lower end of the operation lever 17 is displaced out of the locus of rotation of the pawl 25 on the ratchet wheel 24 (FIG. 3). Just before the one typewriting operation is completed, the electromagnet 4 is again energized and therefore, after the typewriting operation has been completed, the rocking lever 8 which has been in engagement with the outer periphery of the cam member 10 during the typewriting operation is engaged and rotated by the cam portion of the cam member 10 in the counter-clockwise direction about the shaft 3 against the force of the coiled spring 9 toward the energized electromagnet 6. As mentioned hereinabove, since the combination of the magnetic force of the electromagnet 6 and the force of the coiled spring 5 is greater than the force of the coiled spring 9, as the rocking lever 8 rotates toward the electromagnet 6, the rocking lever 8 is attracted to the energized electromagnet 6.

As is clear from the foregoing description of one preferred embodiment of typewriting device of the invention, the typewriting device comprises the continuously rotating type-carrying drum drivingly connected to a drive source, the continuously rotating ratchet wheels drivingly connected to the drive source in synchronization with the type-carrying drum and having the pawls thereon, the operation levers rotatably mounted on the common shaft in opposition to the respective cam members for rotation and vertical movement relative to the common shaft, the hammer levers pivoted to the common shaft between the type-carrying drum and operation levers normally subjected to force which urges the hammer levers away from the type-carrying drum and adapted to strike against the type-carrying drum in response to the operation of the operation levers, respectively, the armatures pivoted to the common shaft adapted to be attracted to the electromagnets and engage or disengage from the operation levers, respectively, and the rocking levers pivoted to the shaft to which the armatures are also pivoted and adapted to engage and disengage from the armatures to separate the armatures from the electromagnets and also adapted to engage the cam members, respectively, under the force of springs, whereby when a particular type is to be typewritten, a key associated with the particular type is depressed, the electromagnet associated with the depressed key is deenergized whereupon the rocking lever associated with the deenergized electromagnet is pivoted to separate the armature associated with the pivoted rocking lever from the deenergized electromagnet, the armature is then pivoted downwardly to engage the operation lever associated with the pivoted armature to move the operation lever downwardly until the lower end of the operation lever is positioned within the locus of rotation of the pawl on the ratchet wheel associated with the downwardly moving operation lever to cause the operation lever to strike against the hammer lever associated with the actuated operation lever and the hammer lever in turn strikes against the particular type of the types carried on the drum to typewrite the particular letter onto the paper with the paper and ribbon interposed therebetween. After the typewriting operation has been completed, the electromagnet is energized and the operation lever is upwardly moved by spring to position the lower end of the operation lever out of the locus of rotation of the pawl on the rotating ratchet, the operation lever in turn moves the armature upwardly toward the energized electromagent to be attracted thereby and the operation lever is maintained in its rest position because the operation lever has now been disengaged from the ratchet wheel. Therefore, when the operation lever is in its rest position, the parts associated with the rest operation lever are effectively prevented from contacting and/or engaging with each other to thereby protect the parts from possible wear and at the same time, no noise will be generated.

When the typewriting operation is effected, the armature associated with the selected type is separated from the deenergized electromagnet by means of the associated spring-loaded rocking lever, but after the typewriting operation has been completed, the rocking lever carrying the associated armature therewith pivots toward the electromagnet which has been energized again by means of the intermittently rotating cam and the armature is attracted to the electromagnet. Thus, the electromagnet may be one having a relatively low magnetic force. Therefore, since the electromagnet may have a small capacity, the overall typewriting device can be made compact and the production cost of the device can be substantially reduced. And when the electromagnet is deenergized, the armature is separated from the electromagnet by means of the spring-loaded rocking lever whereby the armature engages and moves the associated operation lever which in turn engages and is rotated by the pawl on the ratchet wheel continuously rotating at a high speed. The operation lever thus rotated strikes against the associated hammer lever which in turn pivots to strike against the type-carrying drum so as to effect the typewriting operation at a high speed. Since each of the operation levers is capable of rotating about and of moving vertically along its associated shaft and after the typewriting operation, the lower end of the operation layer is moved out of the locus of rotation of the pawl of the associated rotating ratchet wheel and thus, the so-called double typewriting by the pawl of the continuously rotating ratchet wheel during in a single typewriting operation can be effectively prevented.

In the foregoing description has been made of only one preferred embodiment of the invention, but it will readily occur to those skilled in the art that the same is illustrative in nature, and does not limit the scope of the invention in any way. The scope of the invention is only limited by the appended claims.

What is claimed is:

1. A typewriting device comprising a type-carrying drum continuously driven from a drive source, at least one ratchet wheel continuously driven from said drive source in synchronization with said type-carrying drum and having a pawl in the outer periphery, at least one operation lever mounted on a shaft in opposition to said ratchet wheel for rotation about and movement vertically along said shaft, at least one hammer lever pivoted to a second shaft between said drum and operation lever and normally held away from said drum, said hammer lever being adapted to strike against said drum in response to the operation of said operation lever for effecting a typewriting operation, at least one armature pivoted to a third shaft for engaging and disengaging from said operation lever, at least one electromagnet disposed in opposition to said armature for attracting said armature to said electromagnet when the electromagnet is energized, a rocking lever pivoted to said third shaft for assisting said electromagnet in attracting said armature when the electromagnet is energized and for separating the armature from the electromagnet when the electromagnet is deenergized, and at least one intermittently rotatable cam member disposed in contact with said rocking lever, whereby when said electromagnet is deenergized, said armature is separated from said electromagnet with the assistance of said rocking lever to position said operation lever within the locus of rotation of said pawl of the ratchet wheel to thereby cause said hammer lever to effect a typewriting operation and after said typewriting operation has been completed, said operation lever is displaced out of said locus of rotation of the ratchet wheel pawl and said electromagnet is energized to attract said armature thereto as said rocking lever is moved toward the electromagnet by the action of said cam member.

2. The typewriting device as set forth in claim 1, in which a plurality of armatures and the corresponding number of rocking levers are pivoted at one end to said third shaft each of said armatures being adapted to be attracted to each electromagnet when the electromagnet is energized.

3. The typewriting device as set forth in claim 1, in which a plurality of operation levers are mounted on said first-mentioned shaft and each of said operation levers has a vertical elongate slot therein through which the first-mentioned shaft extends so that the vertical movement of the operation lever along the shaft is limited by the length of said slot.

4. The typewriting device as set forth in claim 1, in which a plurality of hammer levers are pivoted to said second shaft and each of said hammer levers has a striking portion for delivering a typing force against said type-carrying drum and is adapted to have a striking force delivered thereto by the corresponding operation lever.

* * * * *